US009627127B2

(12) United States Patent
D'Antuono

(10) Patent No.: US 9,627,127 B2
(45) Date of Patent: Apr. 18, 2017

(54) HIGH-EFFICIENCY, ENERGY-SAVING DEVICE FOR INSERTING BETWEEN A POWER SOURCE AND A MOTIVE AND/OR LIGHTING POWER LOAD

(75) Inventor: Ernesto D'Antuono, Isola Vicentina (IT)

(73) Assignee: ENERGIA EUROPA S.P.A., Zane' (VI) (IT)

( * ) Notice: Subject to any disclaimer, the term of this patent is extended or adjusted under 35 U.S.C. 154(b) by 578 days.

(21) Appl. No.: 14/131,858

(22) PCT Filed: Aug. 1, 2011

(86) PCT No.: PCT/IT2011/000275
§ 371 (c)(1),
(2), (4) Date: Jan. 9, 2014

(87) PCT Pub. No.: WO2013/018108
PCT Pub. Date: Feb. 7, 2013

(65) Prior Publication Data

US 2014/0145519 A1 May 29, 2014

(51) Int. Cl.
*H01F 27/30* (2006.01)
*H01F 29/02* (2006.01)

(52) U.S. Cl.
CPC ..... *H01F 27/303* (2013.01); *H01F 29/02* (2013.01); *Y10T 307/747* (2015.04)

(58) Field of Classification Search
USPC ..... 307/113; 336/12
See application file for complete search history.

(56) References Cited

U.S. PATENT DOCUMENTS 1,839,148 A * 12/1931 Greene ..... H05B 7/005 307/13
2006/0022783 A1* 2/2006 Owen ..... H01F 30/12 336/5

FOREIGN PATENT DOCUMENTS

DE 599318 7/1934
JP 09312223 12/1997
(Continued)

OTHER PUBLICATIONS

Jawad Faiz et al., *New Solid-State Onload Tap-Changers Topology for Distribution Transformers*, IEEE Transactions on Power Delivery, vol. 18, No. 1, Jan. 2003, pp. 136-141.
(Continued)

*Primary Examiner* — Rexford Barnie
*Assistant Examiner* — Xuan Ly
(74) *Attorney, Agent, or Firm* — Workman Nydegger

(57) ABSTRACT

An energy-saving device (1) inserted between a three-phase power supply (A) and a three-phase load (L), includes a three-phase electrical transformer (10), each phase of which includes a transformation assembly (11) with a primary winding (2) connected at a first end (5) to one phase of the power supply (A) and electromagnetically coupled to a secondary winding (3) connected at its second end (S1) to one phase of the load (L). The device (1) involves the second ends (6) of the primary windings (2) in each of the transformation assemblies (11), lying opposite the first ends (5), being electrically connected to one another by a first switch (4). The device (1) also involves each of the secondary windings (3) being connected in parallel to a second switch (7) for enabling or disabling the operation of the energy-saving device (1) between the power source (A) and the load (L).

6 Claims, 6 Drawing Sheets

(56) References Cited

FOREIGN PATENT DOCUMENTS

| | | |
|---|---|---|
| JP | 10079315 | 3/1998 |
| WO | 97/05536 | 2/1997 |
| WO | 2007/037609 A1 | 4/2007 |

OTHER PUBLICATIONS

International Search Report and Written Opinion dated Mar. 22, 2012, issued in PCT Application No. PCT/IT2011/000275, filed Aug. 1, 2011.

* cited by examiner

SAVING measurement

BYPASS measurement

203 Total consumption: 7107 KWh
Average power: 98743,05 W
204

303 Total consumption: 7919,6 KWh
Average power: 109951,6 W
304

| | | |
|---|---|---|
| 401 | Saved Energy: | 811,8 KWh (270,6 per day) |
| 402 | Money saving: | 81,18€ (27,06€ per day) |
| 403 | Energy saving: | 10,25% |

HIGH-EFFICIENCY, ENERGY-SAVING DEVICE FOR INSERTING BETWEEN A POWER SOURCE AND A MOTIVE AND/OR LIGHTING POWER LOAD

BACKGROUND OF THE INVENTION

1. Field of the Invention

This invention concerns an energy-saving device capable of reducing the energy consumption determined during the supply of electrical energy from a power source to a load.

2. Present State of the Art

It is common knowledge that it is necessary to transform the values of the electrical energy supplied by the mains power supply network in order to suitably power one or more loads consuming motive and/or lighting power.

To achieve said transformation it is consequently necessary to insert a static electrical machine between the power source and the loads to supply that is capable of converting the values of the input electrical quantities, i.e. the input voltage $V_i$ and the input current into suitable output values $V_o$ and $I_o$.

Such machine is known by the name of power transformer.

It is also common knowledge that a transformer generally incurs energy losses due to various factors, such as the loss in potential due to the Joule effect in the windings, or the losses due to dispersion of the flows.

These unwanted losses coincide with a high energy consumption during the operation of a transformer and a consequently reduced efficiency.

The above-mentioned disadvantages are greater, the higher the power of the electrical energy being controlled.

For this reason, energy-saving devices have been proposed on the market for inserting and enabling between a three-phase power source and one or more three-phase loads in order to attenuate the above-described drawbacks.

Even using such devices, however, it is still impossible to obtain the desirable optimal energy saving.

SUMMARY OF THE INVENTION

The present invention aims to overcome the aforesaid drawbacks.

In particular, the main object of the invention is to produce an energy-saving device that is more efficient than the devices according to the known state of the art.

Another object of the present invention is to produce an energy-saving device capable of attenuating the harmonics contained in the signals of the electrical quantities involved.

A further object of the present invention is to produce an energy-saving device capable of attenuating the distortions coming from the power supply network.

Another object of the invention is to produce an energy-saving device capable of attenuating the inrush current peaks when the transformer starts up, with a balancing of the energy transmission.

Another object of the invention is to produce an energy-saving device capable of attenuating the current peaks in the waveforms at the rated frequency.

A further, not necessarily last, object of the invention is to produce an energy-saving device capable of optimising the regulation of the energy transmission.

The aforesaid objects are achieved by the energy-saving device according to the invention, the characteristics of which are described in the main claim.

In particular, the energy-saving device according to the invention is designed to be inserted between a three-phase power source and a three-phase load, said energy-saving device comprising a three-phase power transformer, each phase of which involves a primary winding electromagnetically coupled to a secondary winding, wherein the primary winding comprises at least two adjacent portions of suitably dimensioned winding.

In particular, the various elements comprising each phase of the three-phase transformer (hereinafter, for the sake of simplicity, called the "transformation assembly") are dimensioned with reference to the rated voltages established on one of the aforesaid two portions (configured as the principal portion), the rated current identified on the secondary winding, and the value of the magnetic induction relating to the configuration defined by said principal portion of the primary winding and secondary winding.

Said reference values are multiplied by specific ratio coefficients, described in detail below, that enable the dimensioning of the various elements forming part of the energy-saving device according to the invention, thereby achieving a high level of efficiency.

Further characteristics of the energy-saving device according to the invention are described in the dependent claims.

The fact that the energy-saving device according to the invention, in the preferred embodiments described in detail below, advantageously involves first and second switching means, enables the passage from a configuration in which said device is enabled to another configuration in which it is disabled without giving rise to anomalous transient operating conditions that could damage the device.

BRIEF DESCRIPTION OF THE DRAWINGS

The above-mentioned objects and advantages are further illustrated in a description of several preferred embodiments of the invention given below as non-limiting examples with reference to the attached drawings, wherein.

DETAILED DESCRIPTION OF THE PREFERRED EMBODIMENTS

Figure 1:
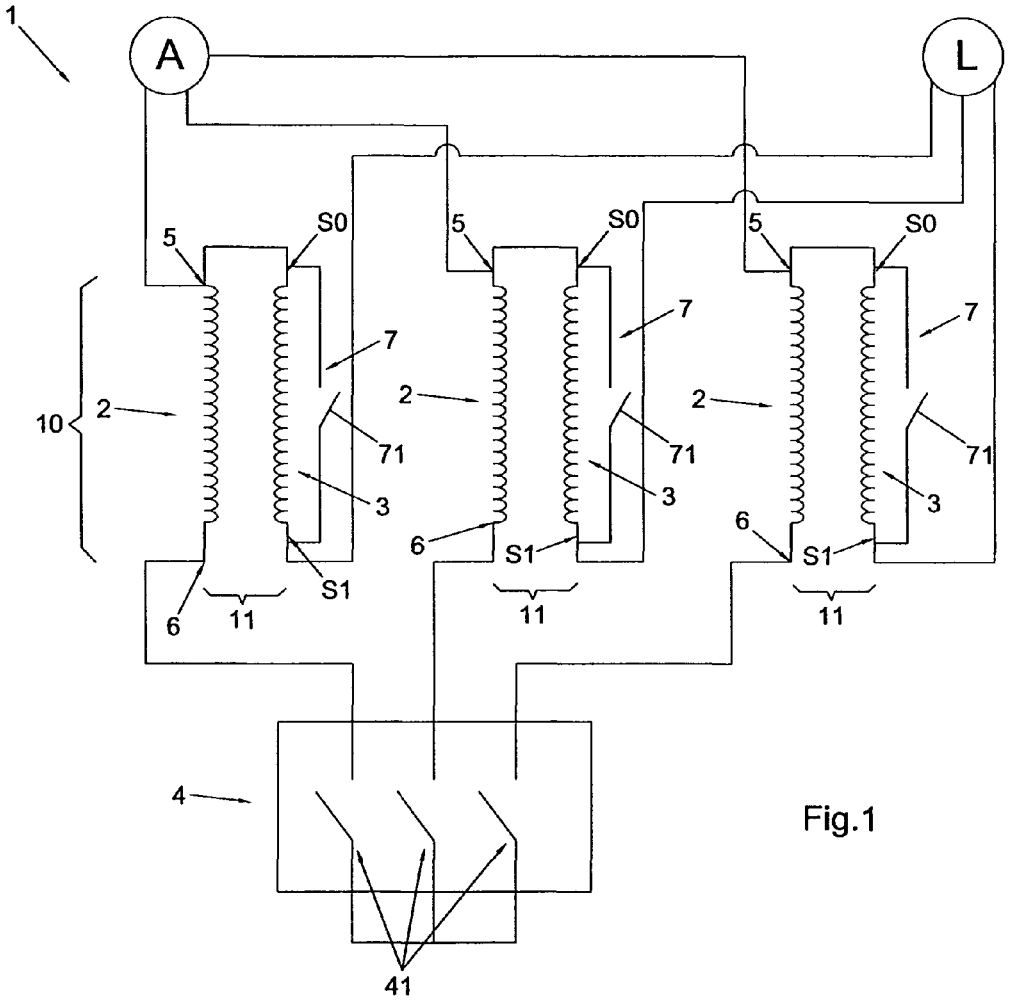
FIG. 1 schematically represents the electrical configuration of the energy-saving device according to the invention.

The energy-saving device according to the invention is globally illustrated in FIG. 1, where it is indicated by the numeral 1.

Figure 9:
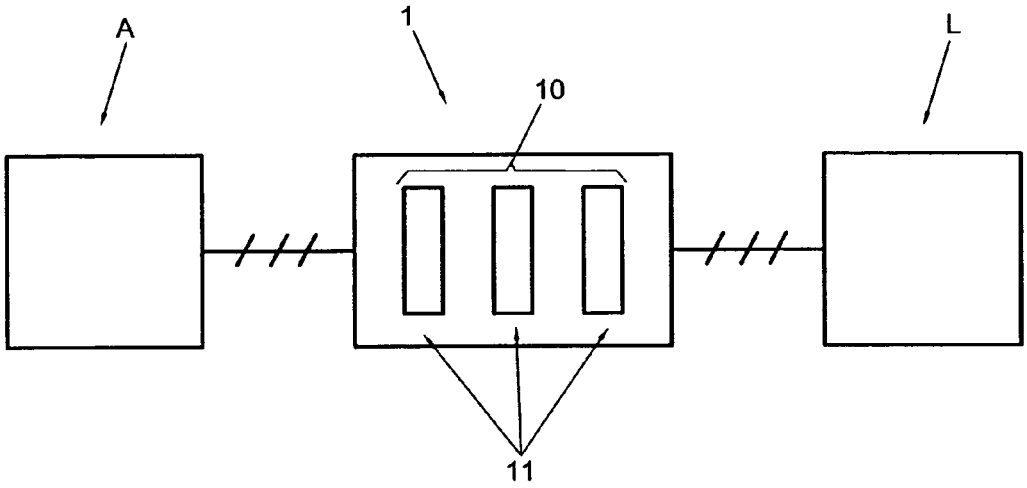
FIG. 9 schematically represents the insertion and usage of the energy-saving device according to the invention between a power source and a load being powered.

As shown in the diagram in FIG. 9, the energy-saving device according to the invention is designed to be inserted between a three-phase power source A (such as a three-phase mains power supply) and one or more three-phase loads L, which may be of the motive and/or lighting power type.

In particular, the energy-saving device 1 according to the invention comprises a three-phase transformer 10, wherein each phase—called the transformation assembly 11—comprises a primary winding 2 electromagnetically coupled to a secondary winding 3.

As shown in FIG. 1, each transformation assembly 11 of the three-phase transformer 10 involves a first end 5 of the primary winding 2 being connected to one phase of the power source A, while the second end S1 of the secondary winding 3 is connected to one of the phases of the three-phase load L.

According to the invention, the first end 5 of each primary winding 2 is short-circuited to the first end S0 of the corresponding secondary winding 3 so as to define a common reference for said two windings 2 and 3.

Again as shown in FIG. 1, the second ends 6 of the primary windings 2 of each transformation assembly 11 have a common connection by means of first switching means 4, which enable the enabling or disabling of the energy-saving device 1 inserted between the power source A and the load L to be powered.

The presence of said first switching means 4 thus enables the energy-saving device 1 according to the invention to be switched from a condition in which it is enabled (called the "saving" configuration in technical jargon) to a condition in which said energy-saving device 1 is disabled and bypassed, and consequently in the so-called "bypass" configuration.

Said first switching means 4 may preferably, but not necessarily, comprise a remote control switch 41 with three contacts, each of which is associated with a transformation assembly 11 of said three-phase transformer 10.

To be able to switch safely from the saving configuration to the bypass configuration, and vice versa, without incurring in transient operating conditions of the energy-saving device 1 that could interfere with its performance or even cause damage, said device 1 according to the invention comprises second switching means 7 that are placed in parallel with each secondary winding 3 of each transformation assembly 11, as shown in FIG. 1.

Said second switching means 7 may preferably, but not necessarily, comprise an isolator 71 with three contacts, each of which is placed in parallel with a corresponding secondary winding 3 of each transformation assembly 11.

It is consequently possible to switch from the saving configuration to the bypass configuration, and vice versa, in total safety and without giving rise to anomalous transient operating conditions of the energy-saving device 1 according to the invention.

In particular, when the energy-saving device 1 is operating in the saving configuration, the first switching means 4 are in the "on" condition, i.e. they close the contact between the second ends 6 of the three primary windings 2, while the second switching means 7 are in the "off", i.e. open, condition and consequently all of the current induced by each primary winding 2 flows through the corresponding secondary winding 3.

Thus, in order to switch to the bypass configuration of the energy-saving device 1 according to the invention, the first step to take is to switch the first switching means 4 to the "off" condition, and thereby open the contact, and only subsequently to switch the second switching means 7 to the "on" condition, thereby short-circuiting each secondary winding 3.

Then to return from the bypass configuration to the saving configuration of the energy-saving device 1 according to the invention, it is necessary to proceed first to switch said second switching means 7 to the "off" condition, i.e. their contact is opened, and only subsequently to switch the first switching means 4 to the "on" condition, i.e. by restoring the common connection between the second ends 6 of the three primary windings 2.

Figure 3:
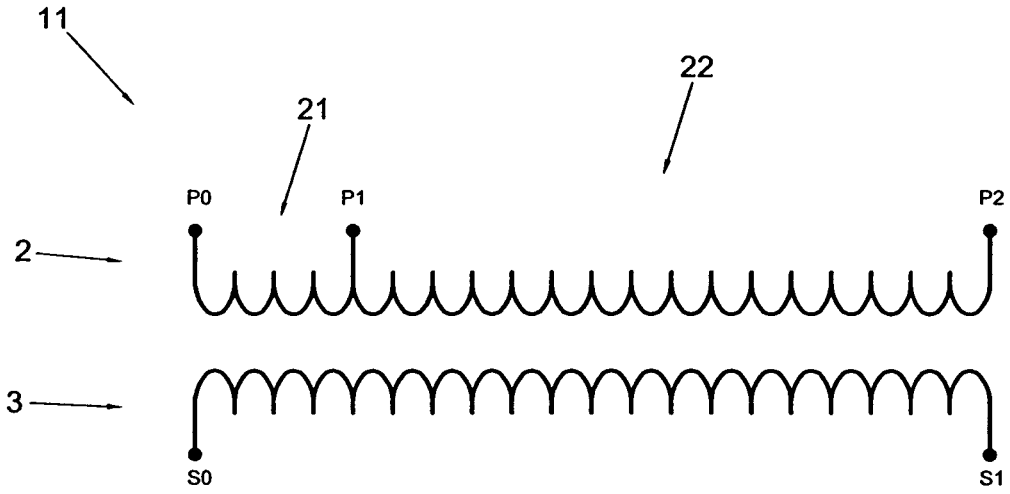
FIG. 3 schematically represents a first embodiment of a single transformation assembly belonging to the three-phase transformer of the energy-saving device according to the invention.

In a first embodiment of the energy-saving device 1 according to the invention as shown in FIG. 3, the primary winding 2 of each transformation assembly 11 comprises two portions of winding 21 and 22 electrically connected in series.

In said embodiment in particular, there is a principal portion 21 extending between a first point P0 (that in this case coincides with the first end 5) and a second point P1 of the primary winding 2, while the second portion of winding 22 extends from said second point P1 to a third point identified in FIG. 3 as P2, which coincides with the second end 6.

Again according to the invention, each pair comprising the primary 2 and secondary 3 windings of the energy-saving device 1 according to the invention is dimensioned so that the value of the voltage $V_{P0\text{-}P2}$ established between the first point P0 and the third point P2 of the primary winding 2—and therefore, in this embodiment, the voltage value established on the whole primary winding 2—is in the range defined by the voltage $V_{kvp}$ applied to the principal portion 21 multiplied by the coefficients 1.2043−2% and 1.2043+2%.

In particular, the value established for the voltage $V_{P0\text{-}P2}$ is preferably, but not necessarily, the result of $V_{kvp}$ multiplied by the coefficient 1.2043.

According to the invention, moreover, the dimensioning of each transformation assembly 11 must be such that the value of the voltage $V_{S0\text{-}S1}$ between the first end S0 and the second end S1 of the secondary winding 3 is in the range defined by said voltage $V_{kvp}$ multiplied by the coefficients 0.1021−5% and 0.1021+5%.

Here again, the value of $V_{S0\text{-}S1}$ is preferably, but not necessarily, obtained by multiplying the voltage $V_{kvp}$ by the coefficient 0.1021.

To adequately dimension both the primary winding 2 and the secondary winding 3 of each transformation assembly 11 in the energy-saving device 1 according to the invention, the value of the current $I_{P0\text{-}P1}$ that flows through the main portion 21 of the primary winding 2 must also be defined.

In particular, said current value $I_{P0-P1}$ is in the range defined by the current $I_{kas}$ flowing in the secondary winding 3 multiplied by the coefficients 0.1133−5% and 0.1133+5%.

The value of the current $I_{P0-P1}$ is preferably, but not necessarily, the current $I_{kas}$ multiplied by the coefficient 0.1133.

Likewise, the value of the current $I_{P1-P2}$ flowing in the second portion 22 shall be in the range defined by said current $I_{kas}$ multiplied by the coefficients 0.0940−5% and 0.0940+5%.

More precisely, the value of the current $I_{P1-P2}$ is the current $I_{kas}$ multiplied by the coefficient 0.0940.

Finally, each transformation assembly 11 forming part of the energy-saving device 1 according to the invention is dimensioned so that the value of the magnetic induction relating to the configuration defined by the primary winding 2, delimited between the first point P0 and the third point P2, and by the secondary winding 3 is in the range defined by the coefficient of magnetic induction $C_{kim}$ relating to the configuration comprising the principal portion 21 of said primary winding 2 and secondary winding 3, multiplied by the coefficients 0.9965−0.03% and 0.9965+0.03%.

Said value of the magnetic induction is preferably, but not necessarily, the coefficient of magnetic induction $C_{kim}$ multiplied by the coefficient 0.9965.

Figure 4:
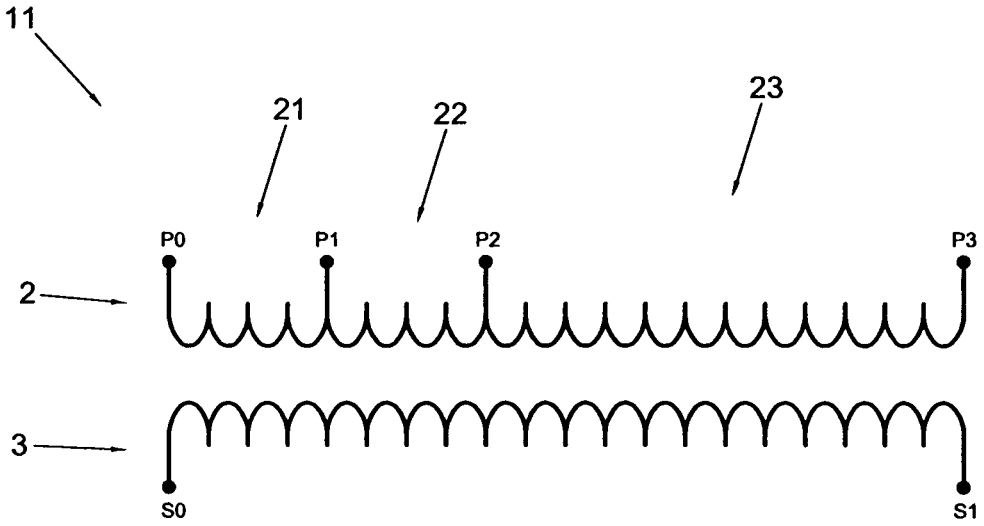
FIG. 4 schematically represents a second embodiment of a single transformation assembly belonging to the three-phase transformer of the energy-saving device according to the invention.

A second embodiment of the energy-saving device 1 according to the invention involves each transformation assembly 11 having a further portion 23 added to the primary winding 2, as shown in FIG. 4, by comparison with said first embodiment in FIG. 3, extending from the third point P2 up to a fourth point P3, that in this case coincides with the second end 6.

Here again, said portion 23 is dimensioned so that the value of the voltage $V_{P0-P3}$ established between the first point P0 and the fourth point P3 of the primary winding 2 is in the range defined by said voltage $V_{kvp}$ multiplied by the coefficients 1.5149−2% and 1.5149+2%.

More precisely, said embodiment involves the voltage value $V_{P0-P3}$ to obtain being the result of the voltage $V_{kvp}$ multiplied by the coefficient 1.5149.

The value of the current $I_{P2-P3}$ flowing through said third portion 23 is in the range defined by the current $I_{kas}$ multiplied by the coefficients 0.0748−5% and 0.0748+5%.

Said current value $I_{P2-P3}$ flowing through said third portion 23 is preferably, but not necessarily, $I_{kas}$ multiplied by 0.0748.

Figure 5:
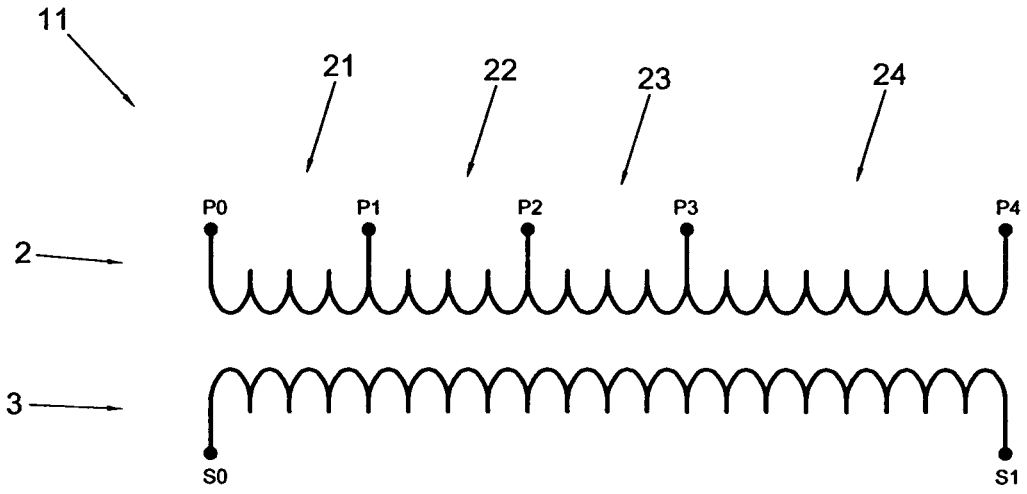
FIG. 5 schematically represents a third embodiment of a single transformation assembly belonging to the three-phase transformer of the energy-saving device according to the invention.

A third embodiment of the energy-saving device 1 involves each transformation assembly 11 differing, as illustrated in FIG. 5, from that of the above-described second embodiment in that a fourth portion 24 is added to the primary winding 2, extending from the fourth point P3 to a fifth point P4, that in this case coincides with the second end 6.

Here again, said fourth portion 24 is dimensioned so that the value of the voltage $V_{P0-P4}$ established between the first point P0 and said fifth point P4 of the primary winding 2 is in the range defined by the voltage $V_{kvp}$ multiplied by the coefficients 2.0851−2% and 2.0851+2%.

More precisely, said voltage value $V_{P0-P4}$ coincides with the voltage $V_{kvp}$ multiplied by the coefficient 2.0851.

In addition, the dimensioning of said fourth portion 24 is such that the value of the current $I_{P3-P4}$ flowing through said portion is in the range defined by the current $I_{kas}$ multiplied by the coefficients 0.0543−5% and 0.0543+5%.

Here again, said current $I_{P3-P4}$ is preferably, but not necessarily, the product of $I_{kas}$ multiplied by 0.0543.

Figure 6:
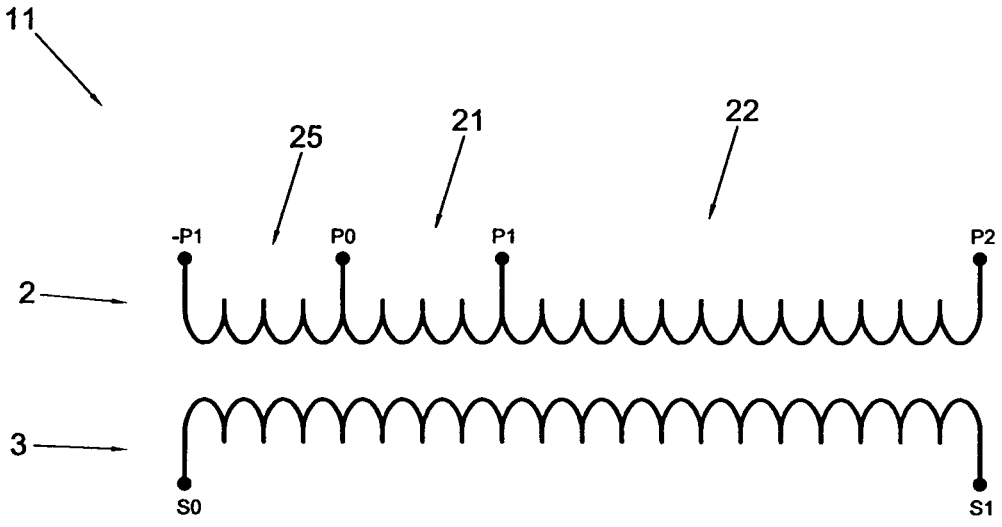
FIG. 6 schematically represents a fourth embodiment of a single transformation assembly belonging to the three-phase transformer of the energy-saving device according to the invention.
Figure 7:
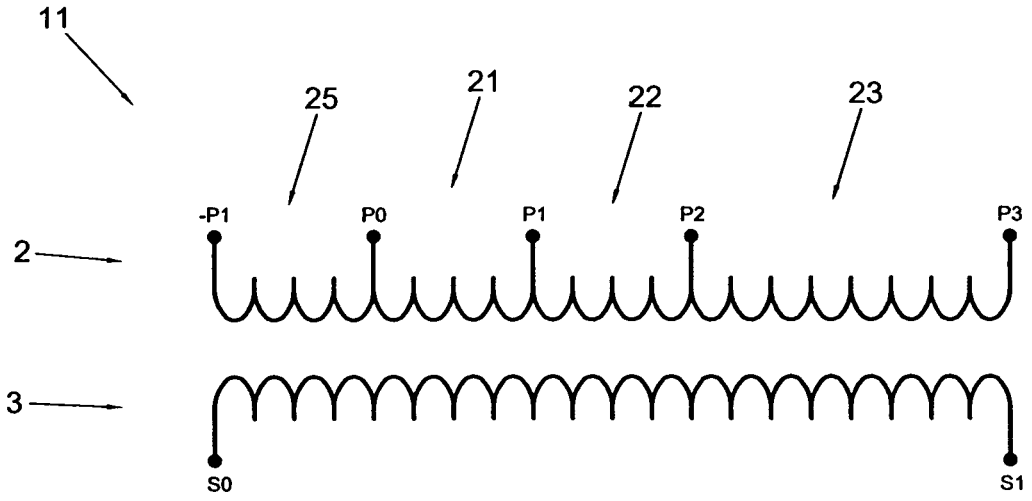
FIG. 7 schematically represents a fifth embodiment of a single transformation assembly belonging to the three-phase transformer of the energy-saving device according to the invention.
Figure 8:
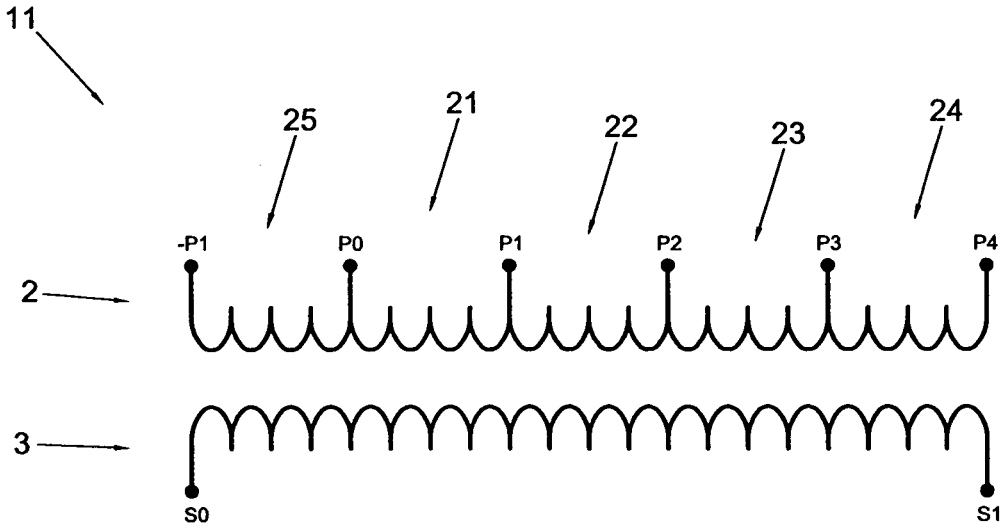
FIG. 8 schematically represents a sixth embodiment of a single transformation assembly belonging to the three-phase transformer of the energy-saving device according to the invention.

FIGS. 6 to 8 respectively illustrate a fourth, fifth and sixth type of transformation assembly 11 belonging to further different embodiments of the energy-saving device 1 according to the invention.

Generally speaking, all these three further embodiments have a characteristic in common, i.e. the fact that the primary winding 2 comprises a so-called safety portion 25 extending from the first point P0 up to a sixth point defined as −P1, that in this case coincides with the above-mentioned first end 5.

In detail, as shown in FIG. 6, the fourth embodiment is simply the first embodiment shown in FIG. 3 with the addition of the safety portion 25, and the fifth embodiment coincides with the second embodiment of the transformation assembly 11 according to the invention, shown in FIG. 4, with the addition of said safety portion 25, as shown in FIG. 7.

Said safety portion 25 is what also distinguishes the sixth embodiment of each transformation assembly 11, shown in FIG. 8, forming part of the energy-saving device 1 according to the invention, from the type of transformation assembly 11 shown in FIG. 5.

In all three cases of FIGS. 6, 7 and 8, said safety portion 25 is dimensioned so that the value of the voltage $V_{-P1-P0}$ established between the sixth point −P1 and the first point P0 of the primary winding 2 is in the range defined by the voltage $V_{kvp}$ multiplied by the coefficients 0.6383−2% and 0.6383+2%; in particular, said voltage $V_{-P1-P0}$ acquires the voltage value of $V_{kvp}$ multiplied by 0.6383.

Moreover, said dimensioning enables a current $I_{-P1-P0}$ flowing through the safety portion 25 to be obtained in the range defined by said current $I_{kas}$ multiplied by the coefficients 0.0691−5% and 0.0691+5%.

Here again, the current value $I_{-P1-P0}$ flowing through the safety portion 25 is preferably, but not necessarily, the current $I_{kas}$ multiplied by the coefficient 0.0691.

As for the methods with which the various elements of each transformation assembly 11 forming part of the various above-described energy-saving devices 1 according to the invention are dimensioned in order to obtain the voltage and current values required, these include choosing a suitable number of turns on the two windings 2 and 3 of each transformation assembly 11, and/or choosing a suitable cross-section for the conductor used to make said primary and secondary windings 2 and 3, and/or choosing the type and size of the ferromagnetic material on which said primary 2 and secondary 3 windings are wound.

As concerns the value of the voltage $V_{kvp}$ taken as a reference for the dimensioning of the various elements in each transformation assembly 11 for the various embodiments of the energy-saving device 1 according to the invention, this may preferably, but not necessarily coincide with the rated voltage of the mains power supply network.

It is nonetheless possible, in different embodiments of the energy-saving device 1 according to the invention, to have a value of the voltage $V_{kvp}$ differing from the voltage of the mains power supply network.

Likewise, for the coefficient of magnetic induction $C_{kim}$, this comes preferably, but not necessarily, in the range of 0.9 to 1.5 Tesla.

Here again, however, in different embodiments of the invention, the value $C_{kim}$ may differ from said range of 0.9 to 1.5 Tesla.

As for the current $I_{kas}$, this obviously depends on the load connected to each secondary winding 3 on each transformation assembly 11 forming part of the energy-saving device 1 according to the invention.

It is important to note that the objects of the invention are achieved by all the previously-described configurations of the energy-saving device 1, in that they advantageously enable a system of feedback control on the energy characteristics, and the harmonics in particular, contained in the signals, i.e. $V_i$ and $I_i$, supplied as input to said device 1 according to the invention.

In particular, it is possible to obtain a deamplification system designed to attenuate the non-functional energy characteristics of the input energy quantities $V_i$ and $I_i$ that interfere with the efficiency of the energy-saving device 1 and of the load L.

Figure 2:
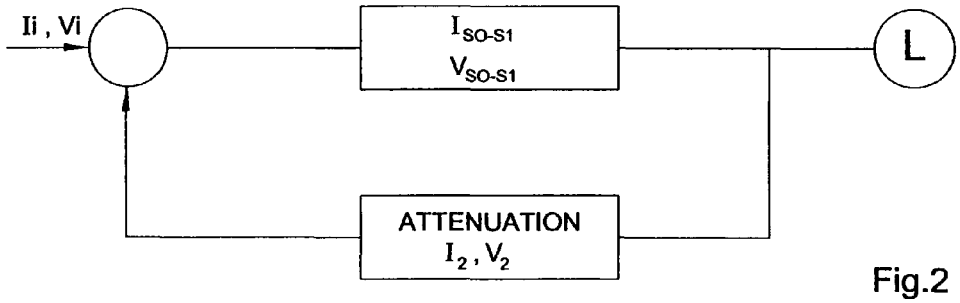
FIG. 2 schematically represents the feedback control that is established during the use of the energy-saving device according to the invention.

In detail, from the functional standpoint, as shown in the diagram in FIG. 2, the currents $I_2$ that flow in the secondary winding 3 of each transformation assembly 11, induce a counter current on each primary winding 2 as a result of magnetic induction that contrasts and reduces the above-mentioned non-functional energy characteristics, and the harmonics in particular, of the input energy quantities $V_i$ and $I_i$ in the primary winding 2.

It is therefore possible to achieve a system for the transformation and supply of electrical energy to a load L that enables output electrical quantities to be obtained with more limited non-functional electrical characteristics (harmonics) and that operates in a smoother and slower steady state both during the inrush phases and when operating at the rated frequency.

Figure 10:
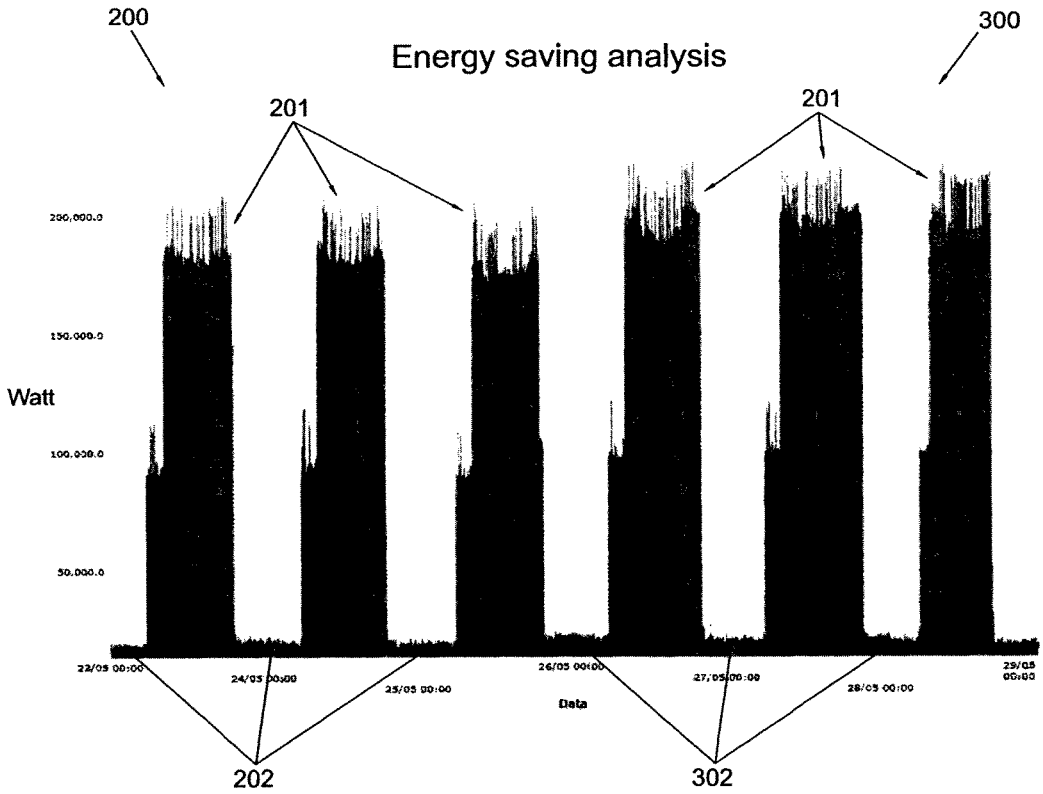
FIG. 10 shows two graphs enabling a comparison of the energy consumption at a commercial complex respectively using (in the "saving" configuration) or not using (in the bypass configuration) the energy-saving device according to the invention.

From experiments conducted by the applicant, as shown in the diagram in FIG. 10, the use of the energy-saving device 1 according to the invention enables an energy saving of no less than 10% to be obtained by comparison with the use of the energy-saving devices according to the known state of the art.

In particular, these tests were conducted at a commercial complex covering approximately 6000 $m^2$ and lasted for six days, during three of which the energy-saving device 1 according to the invention was enabled, while for the other three days said device 1 was bypassed.

The loads at the above-mentioned commercial complex consisted of approximately 8% for electronic equipment, 77% for lighting, 5% for escalators, and 10% for lifts.

From the two graphs 200 and 300 shown in FIG. 10, where the graph on the left (200) represents the outcome of the test with the energy-saving device 1 according to the invention enabled, while the one on the right (300) represents the outcome of the test with said device 1 bypassed, it is clear that in both cases the energy consumption has three peaks 201 and 301 during a 24-hour period coinciding with daytime hours and three troughs 202 and 302 relating to night-time hours, i.e. when the energy consumption is determined exclusively by electronic equipment operating around the clock.

Basically, from a comparison between the two graphs 200 and 300, it is clear that the use of the three-phase transformer 10 according to the invention coincided with a total consumption 203 of 7,107.8 kWh and a mean power absorbed 204 of 98,743.05 W, while during the days of measurements without said energy-saving device 1 enabled the total consumption 303 was 7,919.6 kWh and the mean power absorbed 304 was 109,951.6 W.

It can consequently be claimed that using the energy-saving device 1 according to the invention achieved a saving 401 of 811.8 kWh altogether (270.6 kWh per day) with a consequent monetary saving 402 of approximately 81.18 Euro (27.06 Euro a day) based on the cost of energy in Italy.

Thus, as previously claimed, the percentage energy saving achieved 403, in this particular case, was 10.25%.

Based on the above, it is clear that the energy-saving device 1 according to the invention achieves all the previously-stated objects.

In particular, the invention achieves the object of producing an energy-saving device that is more efficient than the devices according to the known state of the art.

More in detail, the invention achieves the object of producing an energy-saving device capable of attenuating the harmonics contained in the signals of the electrical quantities involved.

In addition, the invention achieves the object of producing an energy-saving device capable of attenuating the distortions coming from the mains power supply.

Another object achieved by the invention is that it produces an energy-saving device capable of attenuating the inrush current peaks during the start-up phase, with the balancing of the energy transmission.

Another object achieved by the invention is that it produces an energy-saving device capable of attenuating the current peaks in the waveforms at the rated frequency.

Another object achieved by the invention is that it produces an energy-saving device capable of optimizing the control of the energy transmission.

In the executive phase, variants of the energy-saving device according to the invention may be developed and, even though they are not described herein, if they come within the scope of the following claims, they shall be deemed to be covered by the present patent.

Where technical characteristics are indicated in the following claims by means of reference signs, these have been added merely for the purpose of facilitating the reading of the claims and said reference signs shall consequently have no limiting effect on the protected scope of each element identified thereby for explanatory purposes.

The invention claimed is:

1. An energy-saving device designed to be inserted between a three-phase power source and a three-phase load, of the type comprising a three-phase electrical transformer, each phase of which comprises a transformation assembly involving a primary winding designed to be connected at a first end to one phase of said power source and electromagnetically coupled to a secondary winding connected at its second end to a phase of said load, wherein the second ends of said primary windings in each of said transformation assemblies lying opposite said first ends are electrically connected to one another by first means for switching, and wherein each of said secondary windings is connected in parallel to second means for switching for enabling or disabling the operation of said energy-saving device between said power source and said load; and wherein said first end of each of said primary windings is connected to said first end of the corresponding secondary winding, so as to define a common reference between said primary winding and said secondary winding.

2. The device according to claim 1, wherein said first means for switching comprise a remote control switch with three contacts, each of which is associated with one of said transformation assemblies.

3. The device according to claim 1, wherein said second means for switching comprise an isolator with three contacts, each of which is connected in parallel to a corresponding secondary winding of each of said transformation assemblies.

4. The device according to claim 1, further comprising:

wherein said first means for switching comprise a remote control switch with three contacts, each of which is associated with one of said transformation assemblies; and wherein said second means for switching comprise an isolator with three contacts, each of which is connected in parallel to a corresponding secondary winding of each of said transformation assemblies.

5. A method for switching from the saving configuration to the bypass configuration of the energy-saving device according to claim 4, comprising the following steps in sequence:

switching the first means for switching to an "off" condition, opening the three contacts between the second ends of the three primary windings;

when said three contacts are open, switching the second means for switching to an "on" condition, short-circuiting each secondary winding.

6. A method for switching from the bypass configuration to the saving configuration of the energy-saving device according to claim 4, comprising the following steps in sequence:

switching the second means for switching to an "off" condition, opening the contact placed in parallel with each secondary winding;

when said three contacts are open, switching the first means for switching to an "on" condition, restoring the common connection between the second ends of the three primary windings;

the common connection between the second ends of the three primary windings.

* * * * *